US005587970A

United States Patent [19]

Greenwood

[11] Patent Number: 5,587,970

[45] Date of Patent: Dec. 24, 1996

[54] PERSONAL ATTACK/HELP ALARM

[76] Inventor: Julie A. Greenwood, 33 Russell Dr., Wollaton, Nottingham NG8 2BA, United Kingdom

[21] Appl. No.: 346,418

[22] Filed: Nov. 29, 1994

[51] Int. Cl.[6] ..... G04B 47/00; G08B 15/00; G08B 13/00

[52] U.S. Cl. ..... 368/10; 368/12; 340/384.4; 340/574

[58] Field of Search ..... 368/10, 12, 72–74, 368/250, 243, 255; 340/384.1, 384.4, 384.6, 384.7, 391.1, 573, 574

[56] References Cited

U.S. PATENT DOCUMENTS

| | | | |
|---|---|---|---|
| 3,733,804 | 5/1973 | Diersbock | 340/309.1 |
| 4,158,197 | 6/1979 | Takagaki | 340/574 |
| 4,591,836 | 5/1986 | Feigenblatt et al. | 340/574 |
| 4,694,284 | 9/1987 | Leveille et al. | 340/574 |
| 4,788,532 | 11/1988 | Maldonado | 340/574 |
| 4,806,911 | 2/1989 | Petri | 340/574 |
| 5,075,671 | 12/1991 | Livingston, III | 340/574 |
| 5,258,746 | 11/1993 | Leitten et al. | 340/574 |

*Primary Examiner*—Vit W. Miska
*Attorney, Agent, or Firm*—Paul & Paul

[57] ABSTRACT

A watch incorporates an alarm signal generating device with activating means for the user comprising a pin which once actuated is not readily resettable by an attacker. The alarm may be tested by alternative operation of the pin.

8 Claims, 2 Drawing Sheets

PERSONAL ATTACK/HELP ALARM

The present invention relates to personal alarm systems and more particularly to an audible personal alarm for use in an emergency situation, for example, while being attacked or threatened, or to help for example in the case of an elderly or visually handicapped person requiring assistance.

Personal attack devices are well known, but have major drawbacks in their designs. In their appearance they tend to be ugly and not aesthetically pleasing or fashionable; they tend to be of large size and are more often than not put into handbags or pockets making their effective access and operation under attack conditions extremely difficult. Even if they are used, they can easily be switched off by the attacker and because of this they are ineffective, are rarely used and not carried at all times.

Personal help systems for elderly or handicapped persons are well known, but have major drawbacks in their designs, due to their requirements of operation, which is usually via a remote switch of some form mounted on a wall which may be difficult to operate if someone has fallen or the situation they are in makes it difficult for them to move.

Accordingly, the present invention overcomes these disadvantages by providing a personal attack/help alarm incorporated within a watch which functions and is worn like any standard watch. This overcomes the major drawbacks of access as watches are worn all the time without thinking. The watch facilities operation in an emergency situation as the actuator can be easily activated from the wrist within seconds.

The present invention provides an alarm means comprising state of the art piezo electronic element and corresponding drive circuitry of known kind; however it will be understood that any suitable sounder means may be used.

In a preferred embodiment the piezo electric sounder mechanism produces approximately 120 dB, but it will be seen that due to the nature of the invention the alarm will be provided with the maximum sound output that current state of the an and legislation allows.

In the present invention there is provided an actuating means which, in a preferred embodiment, is a switch activated by a pin with suitable extension to flow the operator to easily grip the pin and discard it in an emergency situation thus making it extremely difficult to negate the alarm. However, it will be understood that there are a plurality of suitable methods of activation, ie. built in push button, pull switches, electronic latches and the like.

It will be apparent that the present invention could be worn by anyone comfortably and unobtrusively and thus activated easily when required.

A specific embodiment of the invention will now be described by way of example with reference to the accompanying drawings in which.

Figure 1:
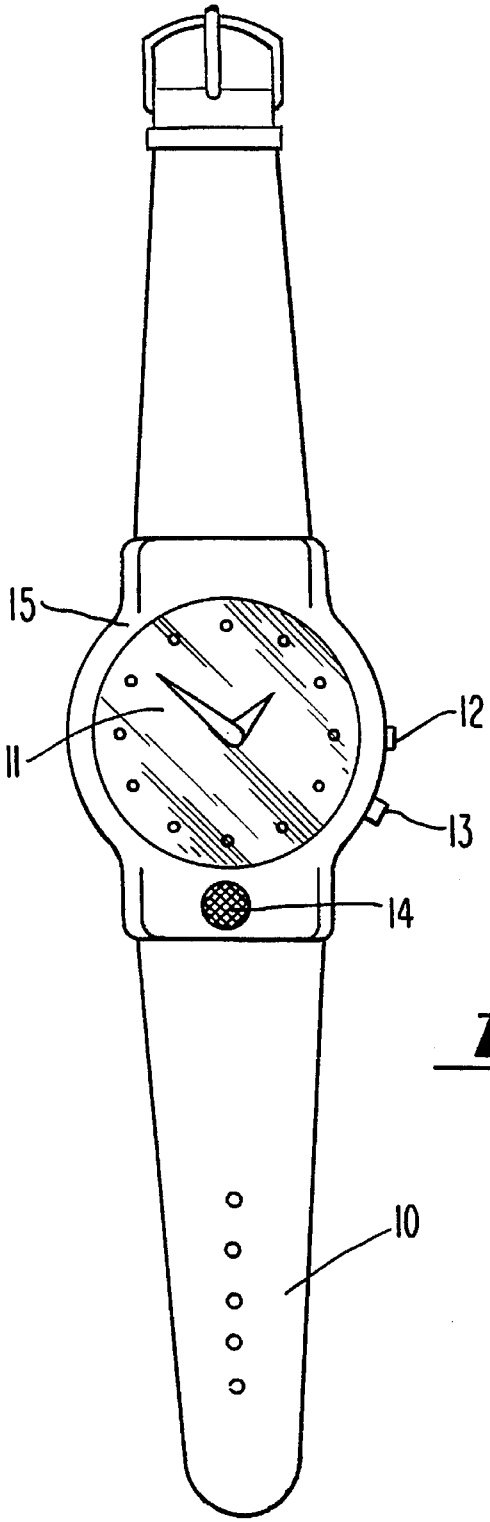
FIG. 1 shows a front view of the general appearance of the watch according to the present invention.

Referring to the drawing in FIG. 1 in the preferred embodiment the personal attack/help alarm comprises a strap 10, watch face 11, winder 12 to adjust the watch hands, sounder activating pin 13, audible sounder 14 and a housing 15 for the watch timing mechanism and electronic circuitry.

The audible sounder may be housed in the watch at any suitable location such as that shown. However, certain state of the art sounders comprise a flat disk of comparable diameter to that of the watch which may conveniently form part of the mar casing of the watch, and may have apertures for the emission of sound at the sides of the watch.

In the present invention there may also be provided an additional remote sensing device which is activated on frequency modulation of the sound output of the alarm as described in its present embodiment to automatically interface with existing alarm systems. For example, in the case of a personal attack at the victim's home, the remote sensing device would interface with the watch by detection of the sound output of the watch, discerning it from other noises by reference to its particular output frequency characteristics. The remote sensing device would then activate an existing burglar alarm or the like. In the ease of the elderly the remote sensing device would interface and activate an existing alarm system, for example a telephone autodialler, to summon for help. However, it will be understood that the remote sensing device will be able to interface with a plurality of alarm systems.

Figure 2:
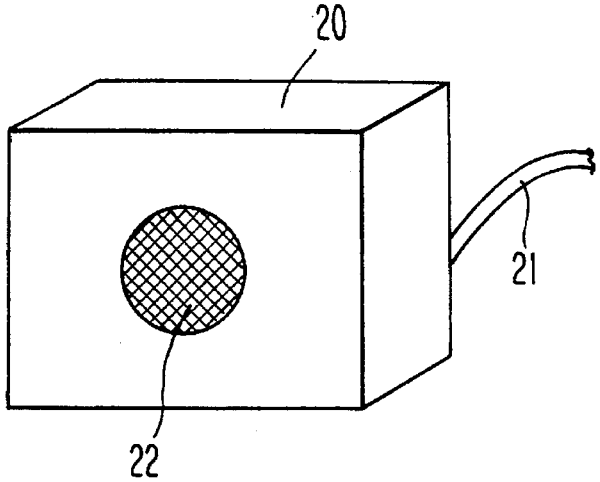
FIG. 2 shows in perspective, the general appearance of the remote sensing device.

Referring to the drawing in FIG. 2, in the preferred embodiment the remote sensing device comprises a housing 20 for electronic circuitry of known kind, circuit wiring 21 to interface with existing alarms, and a suitable sound operated switch 22 to interface with the personal attack/help alarm.

Figure 3:
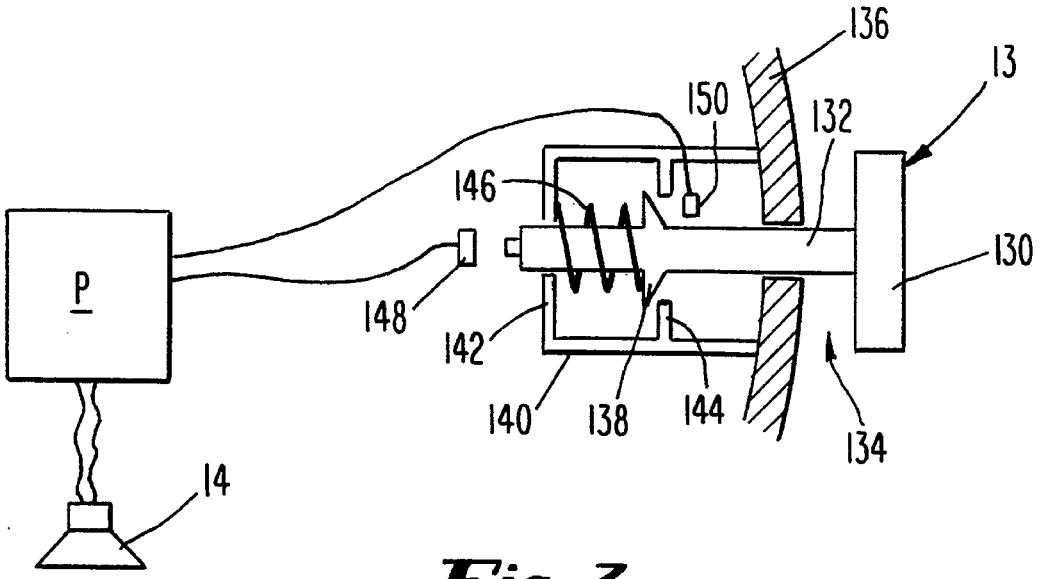
FIG. 3 shows in greater detail a cross-sectional, schematic view of an actuating pin assembly for the watch of FIG. 1.

With reference now to FIG. 3, the activating pin assembly is shown in greater detail for a possible embodiment, shown diagrammatically in cross section.

The pin 13 preferably has a large head 130 attached to an operating shaft 132. The pin head is arranged to have a space 134 between the edge 136 of the watch or other item of jewellery. This space enables a user to readily grip the pin.

The pin may be designed in a variety of shapes but in this embodiment the head 130 is circular and the shaft 132 is generally straight with a flange portion 138 along its length.

The pin is situated within an enclosure 140 with an end wall 142 and an intermediate internal flange section 144 which cooperates with flange 138 as described later.

A spring 146 of the compression type urges the pin 13 outwardly maintaining in the unoperated condition the gap 134.

An electrical test contact 148 is situated adjacent the end of the pin 132 and is operated by contact between pin 132 and the casing 136 (or by suitable second contact means not shown).

A further electrical contact 150 is situated within the enclosure 130 and is also operated by contact between the flange 138 on pin 132 and the casing 136 (or by a suitable second contact means not shown).

The operation of this exemplary embodiment is as follows.

To test the alarm, pin 13 is pressed in until contact 148 is made. This energises piezoelectric generator P and the alarm signal is given via sounder 14. Release of pressure on pin 13 allows spring 146 to return the pin to an unoperated condition. Spring 146 can be made very strong to prevent accidental depression of pin 13.

To activate the alarm, pin 13 is pulled outwardly with sufficient force to cause the flanges 138 to be forced past flanges 144. As presently shown the flanges 138 are bevelled to allow easy passage outwardly but not in the return direction.

Once past flange 144 the flanges 138 will make electrical contact 150, energising piezoelectric generator P and sounder 14.

Dependent on the design of the flanges 138 and 144 the pin 13 may be virtually impossible to return past flanges 144 once pulled out, thus once pulled out the alarm would sound continuously until the battery was exhausted.

Other designs of contact are possible. In an alternative embodiment, the pin, once pulled out would become detached from the watch or jewellery item to be discarded thereby ensuring that the alarm could not be reset. The electrical contacts would in this case be normally-open contacts held open by for example spring 146 or flange 138 which closed on removal of the pin 13.

Other contact designs are also possible wherein for example the pin is pulled outwardly against a spring to test the alarm and pushed in hard to energise the device.

Figure 4:
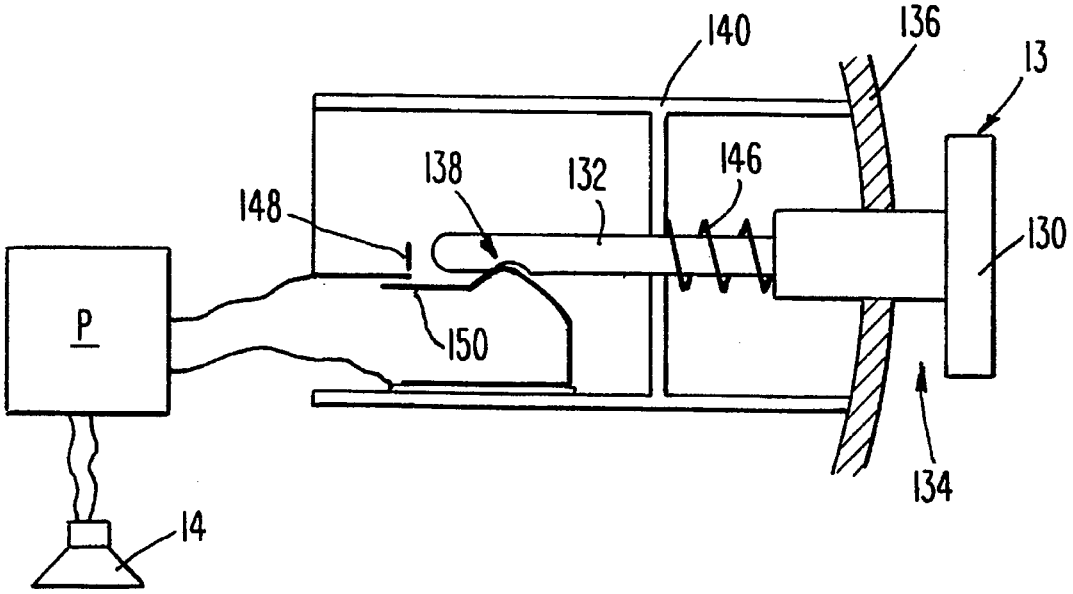
FIG. 4 shows in greater detail a cross-sectional, schematic view of an alternative actuating pin assembly for the watch of FIG. 1.

With reference now to FIG. 4, the activating pin assembly is shown in greater detail for a further possible embodiment, shown diagrammatically in cross section.

Those parts performing the same or similar functions to the parts shown in FIG. 3 are given the same reference numerals.

In this embodiment the spring 146 of the compression type urges the pin 13 outwardly maintaining in the unoperated condition the gap 134.

An electrical contact 148 is situated adjacent the end of the pin 132 and is operated by contact between pin 132 and the contact 150 which is also situated within the enclosure 140.

The operation of this exemplary embodiment is as follows.

To test the alarm, pin 13 is pressed in until contact 148 and 150 is made via the pin operating shaft 132. This will energise the piezoelectric generator P and the alarm signal is given via sounder 14. Release of pressure on pin 13 allows spring 146 to return the pin to an unoperated condition. Spring 146 can be made very strong to prevent accidental depression on pin 13.

To activate the alarm, pin 13 is pulled outwardly with sufficient force to cause the contacts 150 and 148 to make contact. As presently shown the bevelled area 138 of the pin shaft 132 is holding pin 13 in place and preventing contacts 148 and 150 making contact. As presently shown the bevelled area 138 will allow easy passage outwardly.

Once contacts 148 and 150 make contact the piezoelectric generator P and sounder 14 will energise.

Thus once pulled out the alarm would sound continuously until the battery was exhausted.

In the preferred embodiment the pin, once pulled, would become detached from the watch to be discarded thereby ensuring that the alarm could not be reset. The electrical contacts 148 and 150 in this case are normally open contacts held open by the pin operating shaft 132 which close on removal of the pin 13.

It will be understood that the size of the pin 13 used in the present invention will as a matter of course be sufficiently small that it is most unlikely that an attacker could readily retrieve it in order to silence the alarm if the wearer of the watch threw the pin away.

A watch according to the present invention could, however, be supplied with a number of pins 13 to enable the owner to reset the watch at a later time.

Other contact designs are also possible wherein for example the pin is pulled outwardly against a spring to test the alarm and pushed in hard to energise the device.

A particular advantage of the present invention is that a watch is securely attached to the individual wearing it, rendering it very difficult for an attacker to hurriedly detach the alarm from the person, and discard it. This feature confers considerable advantages on the present invention compared with, for example, an attack alarm which might be merely hung around the neck or from a belt.

As additional security, the watch may be provided with a strap which incorporates a secure locking mechanism which further inhibits removal in a hurry by an attacker.

An attack alarm incorporated into a watch is also particularly advantageous because it is readily accessible to the wearer whatever additional clothing is being worn. Alarms attached to a belt, or hung around the neck may, for example, be inadvertently covered by outdoor clothing and the like.

I claim:

1. A personal attack/help alarm incorporated within a watch to be worn by an operator, the alarm comprising an alarm signal generating device and activating means accessible externally to enable the alarm to be activated by the operator, and in which the activating means is a pin switch arrangement, in which the pin switch arrangement comprises a two position device, a first position for testing the alarm and a second position for full activation of the alarm, and in which the second position the pin is completely removed from the watch.

2. A personal attack/help alarm as claimed in claim 1 in which in the second position the pin is moved past a flange which co-operates with the pin to prevent return of the pin except under substantial force.

3. A personal attack/help alarm as claimed in claim 1 in which the alarm signal generating means comprises a piezoelectric sound generator.

4. A personal attack/help alarm as claimed in claim 1 further including a remote sensing device adapted to interface with said personal attack/help alarm, said remote sensing device including means to trigger an external alarm system upon detection of audible alarm signal generated by said personal attack/help alarm.

5. A personal attack/help alarm incorporated within a watch to be worn by an operator, the alarm comprising an alarm signal generating device and activating means accessible externally to enable the alarm to be activated by the operator, and in which the activating means is a pin switch arrangement, in which the pin switch arrangement comprises a two position device, a first position for testing the alarm and a second position for full activation of the alarm, and in which the first position the alarm is tested by movement of the activating pin against a return spring.

6. A personal attack/help alarm as claimed in claim 5 in which in the second position the pin is moved past a flange which co-operates with the pin to prevent return of the pin except under substantial force.

7. A personal attack/help alarm as claimed in claim 5 in which the alarm signal generating means comprises a piezoelectric sound generator.

8. A personal attack/help alarm as claimed in claim 5 further including a remote sensing device adapted to interface with said personal attack/help alarm, said remote sensing device including means to trigger an external alarm system upon detection of audible alarm signal generated by said personal attack/help alarm.

* * * * *